United States Patent [19]

Mori et al.

[11] 4,222,674

[45] Sep. 16, 1980

[54] HEAD PORTION OF A DOT PRINTER

[75] Inventors: Masahiko Mori; Seiji Hanaoka; Takao Kobayashi, all of Shiojiri, Japan

[73] Assignees: Kabushiki Kaisha Suwa Seikosha, Tokyo; Shinshu Seiki Kabushiki Kaisha, Nagao, both of Japan

[21] Appl. No.: 905,085

[22] Filed: May 11, 1978

[30] Foreign Application Priority Data

May 13, 1977 [JP] Japan ..... 52-55111

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,770,092 | 11/1973 | Grim | 400/124 |
| 3,828,908 | 8/1974 | Schneider | 400/124 |
| 3,896,918 | 7/1975 | Schneider | 400/124 |
| 3,929,214 | 12/1975 | Hebert | 400/124 |
| 3,991,869 | 11/1976 | Berrey | 400/124 |
| 4,049,107 | 9/1977 | Murat | 400/124 |

FOREIGN PATENT DOCUMENTS

| | | | |
|---|---|---|---|
| 1577409 | 8/1969 | France | 400/124 |

*Primary Examiner*—Paul T. Sewell

*Attorney, Agent, or Firm*—Blum, Kaplan, Friedman, Silberman & Beran

[57] ABSTRACT

The head portion of a dot printer includes a cup-shaped yoke, an electromagnet on a coil frame, an iron core within said coil frame, said core being securely fixed to said cup-shaped yoke, a second yoke, a movable element comprising a second iron core disposed for attraction by said electromagnet and a holding member for holding said movable element for rotation around a fulcrum on said fulcrum member. The structure is such that tolerances can be held closely in mass production, thereby providing high reliability and high quality printing at low cost.

20 Claims, 11 Drawing Figures

HEAD PORTION OF A DOT PRINTER

BACKGROUND OF THE INVENTION

The present invention relates to a head construction for a dot printer of the mechanical type using electromagnets.

A wide variety of constructions have been used for the heads of mechanical-type dot printers. Conventionally, a moving piece which has been termed an attracted iron piece comprises a moving iron core coupled so that it is attached to or free to turn on moving plates, where the core is attracted by an activated electromagnet. When moved by said electromagnet, a needle engages with the moving piece to be thrust outwardly.

Many constructions of this type have recently been disclosed. However, such constructions suffer from the difficulty that the variation in the gap between the moving iron core and the attracting surface of the electromagnet cannot be decreased without incurring a substantial increase in the cost of manufacture. Accordingly, manufacturing processes have been employed which, although providing high accuracy, require very complex adjustment of the gap, the steps involved causing a substantial increase in the cost of the head. Conversely, where an attempt has been made to lower the cost of manufacture, the variation in the gap has been increased so that where the purpose is improvement in the quality of the print effected by the device, the energy required for printing has been increased. The present invention is designed to overcome these difficulties.

SUMMARY OF THE INVENTION

The head portion of a dot printer in accordance with the present invention includes a first, cup-shaped yoke, an electromagnet having a coil frame which is part of a fulcrum member, a fixed core in said electromagnet, said core being securely fixed to said cup-shaped yoke, thereby establishing the position of said fulcrum member relative to said yoke, a second yoke abutting said fulcrum member, a movable element having a fixed core portion disposed for attraction by said electromagnet and a holding member for holding said movable element against said fulcrum member. The fulcrum member has a support portion or fulcrum around which the movable element can rotate from a rest position to a thrust position in which one end thereof engages a spring-biased needle for a printing operation. In general, the needle is moved by one end of said movable element. Either the other end of said movable element or an intermediate portion thereof may make contact with said fulcrum for rotation therearound, the fixed core thereof being disposed either intermediate said two ends or at said other end. Preferably, the distance between said two ends is about three times the distance between the fixed core of said movable element and the portion thereof engaging said fulcrum.

Accordingly, an object of the present invention is a a head portion of a dot printer of low cost which provides high printing quality and high reliability.

Another object of the present invention is a head portion of a dot printer wherein a movable element having a fixed core portion for attraction by an electromagnet provides for control of the gap between said fixed core portion and the attracting portion of said electromagnet so that the variation in said gap is greatly reduced below that of conventional constructions.

A significant object of the present invention is a method of manufacturing a coil frame for a coil frame of a head portion of a dot printer.

An important object of the present invention is a coil frame of a head portion of a dot printer, said coil frame being of improved accuracy.

Still other objects and advantages of the invention will in part be obvious and will in part be apparent from the specification.

The invention accordingly comprises the several steps and the relation of one or more of such steps with respect to each of the others, the apparatus embodying features of construction, combinations and arrangement of parts which are adapted to effect such steps, and the product which possesses the characteristics, properties, and relation of constituents, all as exemplified in the detailed disclosure hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
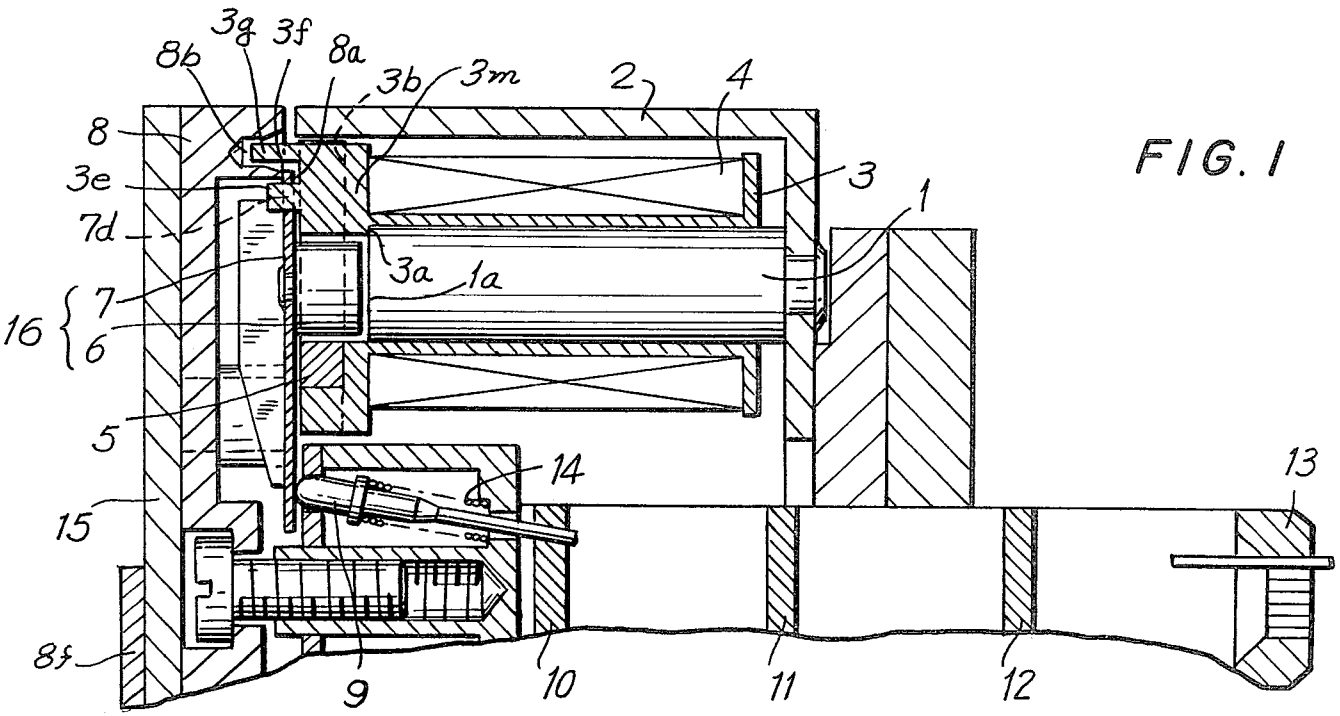
FIG. 1 is a sectional view of an embodiment of the head portion of a dot printer in accordance with the present invention.
Figure 2:
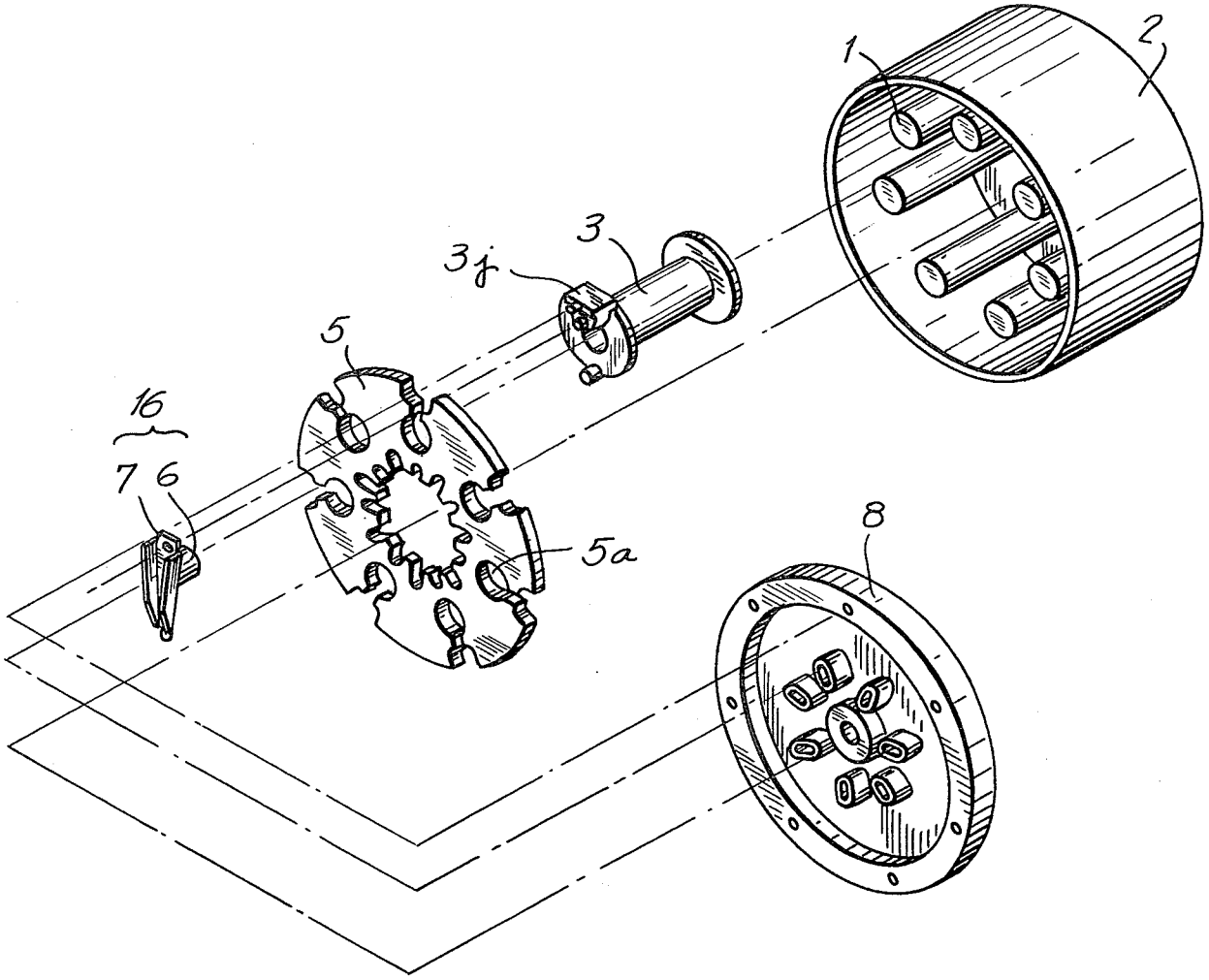
FIG. 2 is an exploded view in perspective of said embodiment.

An example of a head portion for a dot printer in accordance with the present invention is shown in sectional view in FIG. 1 and in exploded perspective view in FIG. 2. An electromagnet is comprised of a coil 4 on a coil frame and a fixed iron core 1. Iron core 1 is affixed to cup-shaped yoke 2, thereby establishing the position of coil frame which is part of fulcrum member 3. Fulcrum member 3 has a stepped surface 3*a* which abuts end face 1*a* of the fixed iron core 1 for positioning thereof. End face 1*a* is the attracting surface when the electromagnet is activated. Fulcrum member 3 also has another stepped surface 3*a* which makes contact with second yoke 5 so that said member 3 is held between attracting surface 1*a* of fixed iron core 1 and second yoke 5 by the stepped surfaces 3*a* and 3*b*.

Figure 3A:
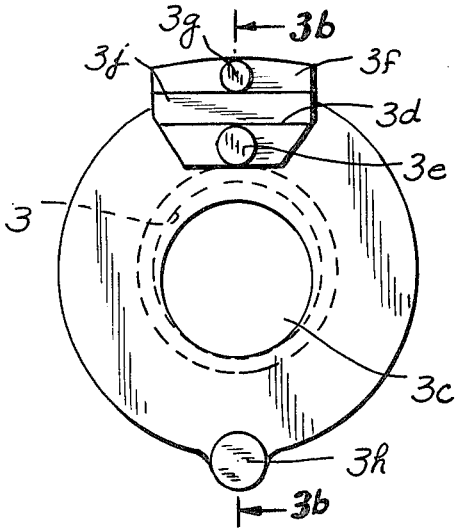
FIG. 3*a* is a plan view of the fulcrum member of said embodiment.
Figure 4:
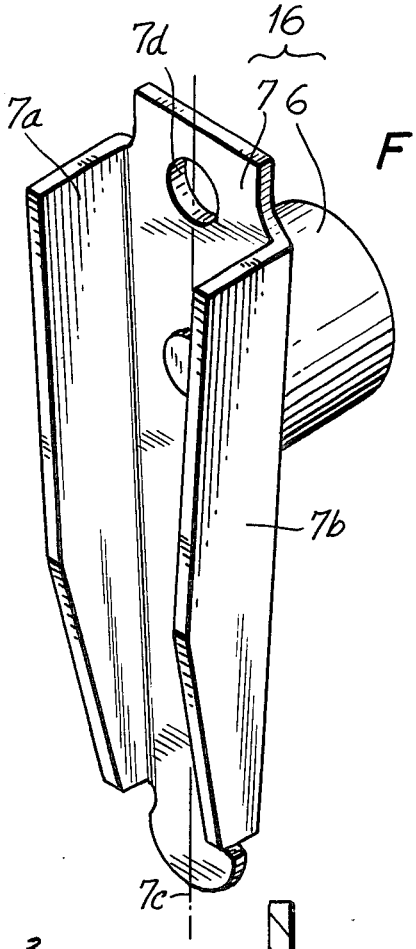
FIG. 4 is a perspective view of a movable element for actuating a printing needle.

Fulcrum member 3 and second yoke 5 have openings, respectively 3*c* (FIG. 3*a*) and 5*a* (FIG. 2) into which moving iron core 6 fits with clearance, moving iron core 6 being securely attached to frame 7, frame 7 preferably being of iron (FIG. 4). Frame 7 is bent into U-shape in order to provide flexural rigidity thereto. Frame 7 and iron core 6 together comprise movable element 16. Movable element 16 is disposed for making contact with fulcrum member 3.

Figure 3B:
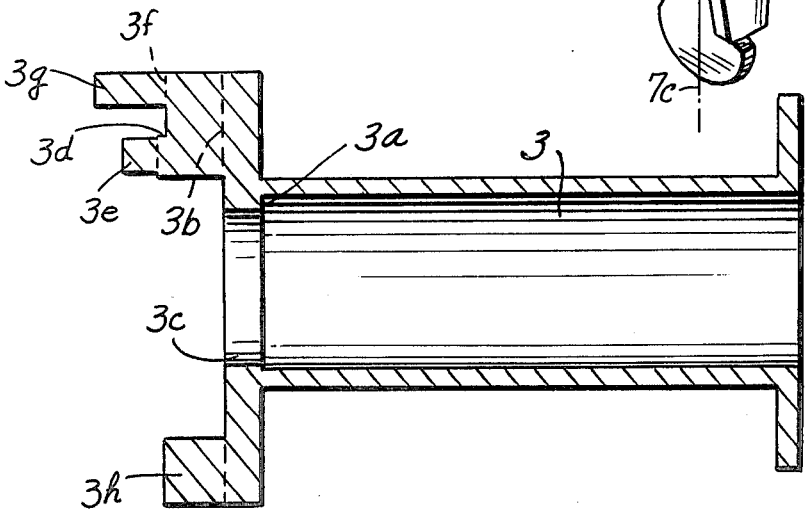
FIG. 3*b* is a sectional view taken along line 3*b*—3*b* of FIG. 3*a;*

Referring now to FIGS. 3*a* and 3*b*, a support portion, or fulcrum, 3*d* is provided for making contact with movable element 16 for rotation around said fulcrum. A projection 3*e* is provided as closely as possible to fulcrum 3*d* and an opening 7*d* is provided on moving piece 16 for fitting projection 3*e*, the combination of projection 3*e* and opening 7*d* cooperating to hold movable element 16 in proper engagement and alignment with fulcrum 3*d*.

Figure 5A:
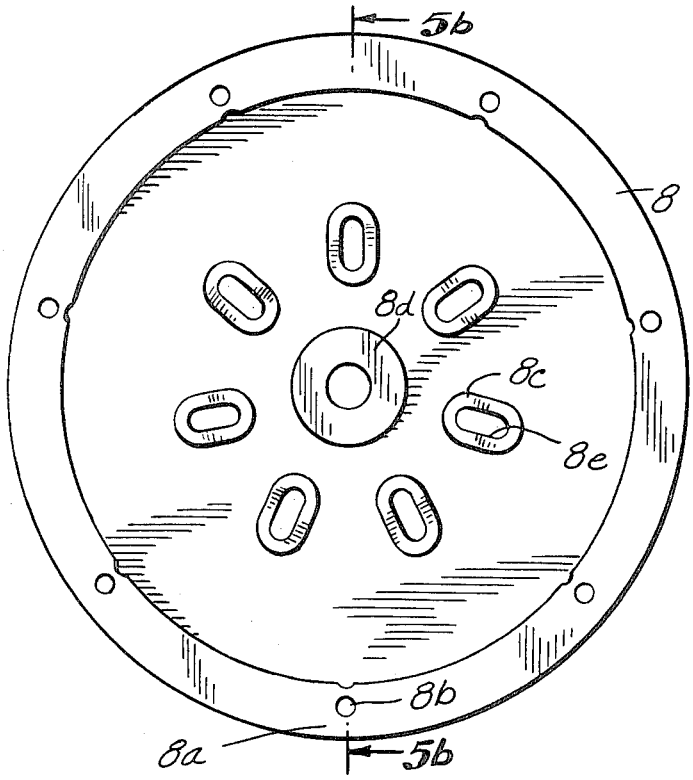
FIG. 5*a* is a plan view of a holding member.
Figure 5B:
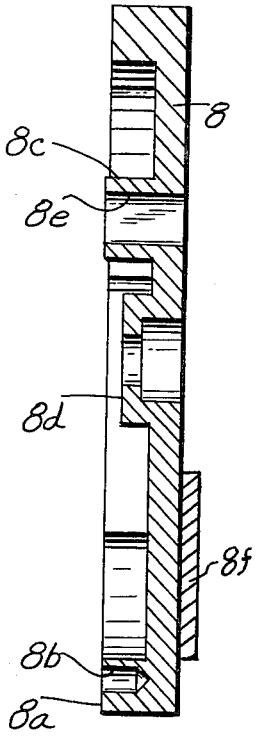
FIG. 5*b* is a sectional view of said holding member taken along line 5*b*—5*b* of FIG. 5*a;*

A holding member 8 is shown in FIG. 5*a* and FIG. 5*b*, said holding member having a surface 8*a* for holding said moving piece 16 so that it can oscillate freely about fulcrum 3*d*. A seat 3*f* (FIG. 1) is formed on fulcrum member 3 against which holding member 8 abuts. So that the moving element 16 can oscillate freely, the seat 3*f* is positioned outwardly of the coil frame 3 by a distance such that a gap is provided in the direction of the thickness of frame 7 between movable core 6 and fixed iron core 1. Seat 3*f* has a projection 3*g* thereon which fits into a recess 8*b* in holding member 8. The dimensions are such as to allow the surface 8*a* to bear against seat 3*f*.

As shown in FIGS. 5*a* and 5*b*, holding member 8 has a boss 8*c* which has therein an aperture 8*e*. The sides of boss 8*c* serve to guide the side portions 7*a* and 7*b* of frame 7 of moving element 16. Recesses 8*b* of holding member 8 and projections 3*g* of fulcrum member 3 insure that the holding member 8 will be positioned when assembled with fulcrum member 3 so that an adjoining pair of bosses 8*c* are symmetrical to center line 7*c* and that moving element 16 can oscillate freely.

Moving element 16 engages the butt end of needle 9 at one end of said moving element. Needle 9 is guided by intermediate guides 10, 11 and 12 and end guide 13 and biased by return means 14, preferably a coil spring, so that needle 9 makes contact with one end of frame 7. Holding member 8 is also provided with a stopper portion 8*d*, the surface thereof being located at the central part of said holding member. The surface thereof, also being referred to by reference character 8*d* serves for bringing moving element 16 to a halt and for establishing the rest position thereof, said moving element 16 being in rest position when coil 4 is unactivated. In this condition, moving element 16 is urged against stopper portion 8*d* by biasing means 14.

Considering moving element 16, initially in rest position and needle 9 also being in rest position, the system is activated by passing current through coil 4 whereupon the core attached to frame 7 is attracted by fixed iron core 1 so that moving element 16 causes needle 9 to move toward the direction of end guide 13 against the force of return means 14, printing then being effected by causing needle 9 to engage a printing medium on a platen (not shown). Subsequently, the current pulse which activates the structure is terminated and needle 9 returns to rest or standby position.

Opening 8*e* in holding member 8 is usefully employed for providing transit therethrough of leads to the corresponding electromagnet. Holding member 8 also bears printed circuitry 8*f* for controlling the activation of the electromagnets.

Figure 6:
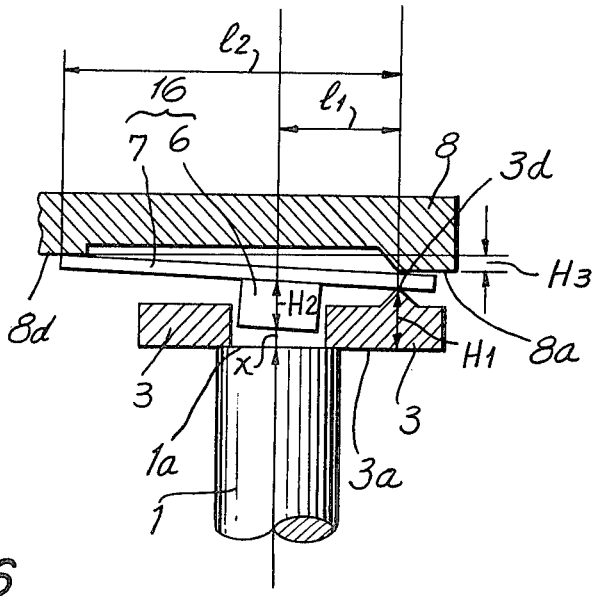
FIG. 6 is a view showing the members which control the gap between a fixed core of said movable element and an electromagnet.

A significant element in the head construction of the present invention is the disposition of the fulcrum 3*d* on fulcrum member 3, said fulcrum member abutting the attracting surface 1*a* of fixed iron core 1 for positioning said coil frame. The relationship between fixed iron core 1, fulcrum member 3 and moving element 16 which comprises frame 7 and moving iron core 6 and holding member 8 is best shown in FIG. 6. Take x as the gap between the fixed iron core 1 and the moving iron core 6, and $H_2$ as the height (or thickness) of the moving iron core in the vicinity of the center line of said core and the fixed iron core, and $H_1$ as the distance between fulcrum 3*d* and surface 3*a* which is in contact with 1*a* of fixed iron core 1, and $H_3$ as the distance in the direction of said center line from surface 8*a* of holding member 8 against which frame 7 seats. Also, take the distance between fulcrum 3*d* and the center line of moving iron core 6 as $l_1$ and the distance from fulcrum 3*d* to the point where frame 7 makes contact with stopper portion 8*d* as $l_2$. Then, assuming that the thickness of the frame 7 is uniform in the longitudinal direction, x can be expressed by means of the following formula:

$$x = H_1 - H_2 + H_3 \cdot l_1 / l_2 \qquad (1).$$

It should be noted that x is the distance between fixed iron core 1 and moving iron core 6 when moving element 16 is in rest or standby position:

Where the construction of the head is such that x is subject to considerable variation, then the attractive force of the electromagnet is likewise greatly affected by this variation. As a result, there will be similar variation in the kinetic energy provided to the needle for moving same into contact with the printing medium. This will again cause great variation in the point value for the printing pressure between the printing medium and the needle which can lead to serious degradation of the printing quality. As is evident, the factors which control the variation in the gap x are the sizes of the various dimensions, namely $H_1$, $H_2$, $H_3$, $l_1$ and $l_2$, the variations in these quantities being determined by the manufacturing accuracy and the accuracy of assembly of the parts. The manufacturing accuracy can be improved only if a high-precision machine tool is employed, such machine tools being slow in operation so that operation by this means cannot provide high quality products in mass production at low cost. In addition, there is a certain limit to the working accuracy in mass production. Further, the assembling accuracy also is limited and dependent largely upon the design and the need for ease in assembly by relatively unskilled help. It is therefore important to make an effort to decrease the number of parts which constitute factors in establishing the variation in the gap. However, mere reduction in the number of components cannot effect the desired reduction in cost.

The construction in accordance with the present invention has resulted in a decrease in the number of components whose dimensions are determinants in decreasing the variation in the gap and simultaneously minimizing cost. In short, it is possible to suppress the variation of $H_1$ so that it does not exceed $\pm 0.05$ mm if fulcrum member 3 is made of a synthetic resin by means of injection molding. This reduction can also be effected if it is made of a non-magnetic material by a sintering process. The dispersion of $H_2$ can also be controlled within approximately $\pm 0.05$ mm most reliably only if moving iron core 6 is manufactured using automatic machinery. Variation in $H_3$ is established by the working accuracy of holding member 8 and the assembling accuracy with which the other parts are put together. If this accuracy is held to ±0.15 mm, where $l_1/l_2$ is approximately ⅓, then the variation in the third term on the right-hand side of formula (1) can also be held to about ±0.05 mm. As a result of control of these factors as indicated, the variation of x is held to ±0.15 mm at maximum. It should be noted that it has been found that the respective variations of $H_1$ and $H_3$ can actually be held to quantities less than those specified above so that the variation in the gap x is even smaller than indicated above. As a result, adjustment of the gap by either manual or automatic means where the structure is manufactured in accordance with the present invention has been rendered completely unnecessary with a large reduction in the cost. The reason, as is evident, is that the number of factors involved in determining the gap has been reduced by a factor of about 3, or at least, 2.5.

Figure 7:
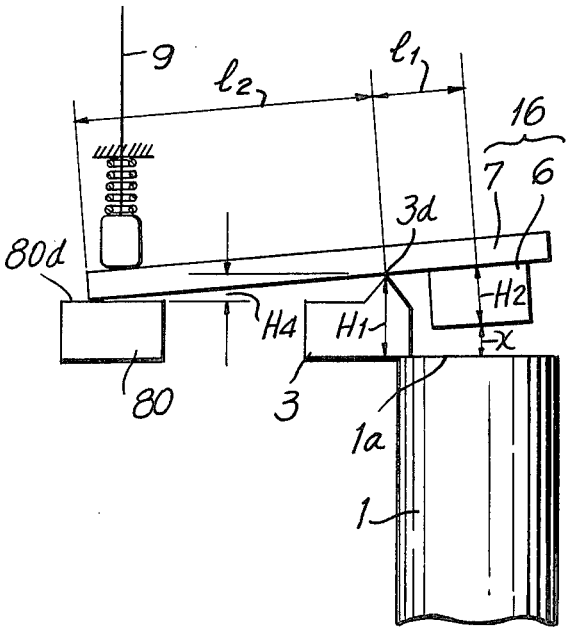
FIG. 7 is another embodiment of said movable element shown in relation to said electromagnet.

In the embodiment shown thus far, moving element 16 has been constructed so that it is supported at one end thereof. In the embodiment shown in FIG. 7, fulcrum 3*d* makes contact with frame 7 at an intermediate portion thereof. Moving iron core 6 is positioned at one end of frame 7, the other end of frame 7 engaging needle 9 at one surface thereof. The other surface thereof is brought to rest by surface 80*d* of holding member 80 which thereby determines the standby position for frame 7 and needle 9. The respective dimensions of $H_1$, $H_2$, $H_4$, $l_1$ and $l_2$ are shown in FIG. 7 and are the same as in FIG. 6 except for $H_4$. As is evident, $H_4$ now replaces $H_3$ in the formula which expresses x and the significance of the two quantities is the same.

Figure 8:
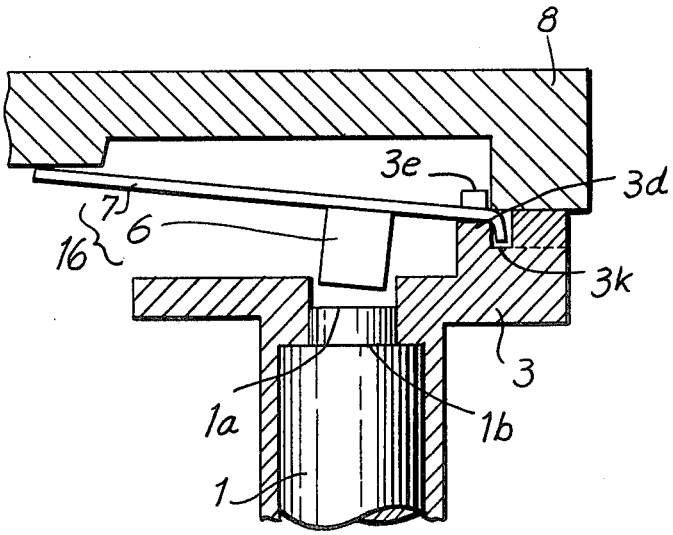
FIG. 8 shows the relationship between said fulcrum member and a fixed iron core of said electromagnet.

In the first embodiment, one surface of fulcrum member 3 was shown as being in contact with attracting surface 1*a* of fixed iron core 1. However, other arrangements are possible. As shown in FIG. 8, for example, fulcrum member 3 abuts stepped iron core 1. In this case, variation in the dimensions of step 1*b* and attracting surface 1*a* introduce additional variation into the gap x so that this variation must be controlled to be as small as possible, but at low cost. The step or component which brings the moving element to rest and which locates the holding member with respect to the coil frame will ordinarily be provided near attracting surface 1*a*.

In the embodiments disclosed thus far, the core frame has been utilized as the fulcrum member. However, the fulcrum member can be any element in the apparatus, the position of which can be established by abutting same against the fixed iron core and which will permit the fulcrum for the moving element to be made as one solid piece therewith. As indicated in connection with the embodiments disclosed thus far, the stopper portion which determines the rest or standby position for the frame need not be integral with or a portion of holding member 8, rather, it may be attached to any member which is securely attached to or positioned relative to holding member 8 such as members to be brought to a halt or positioned by fulcrum member 3 or the second yoke. Such an arrangement becomes possible because, as described above, the dimension $H_3$ is maintained with considerable accuracy.

Figure 9:
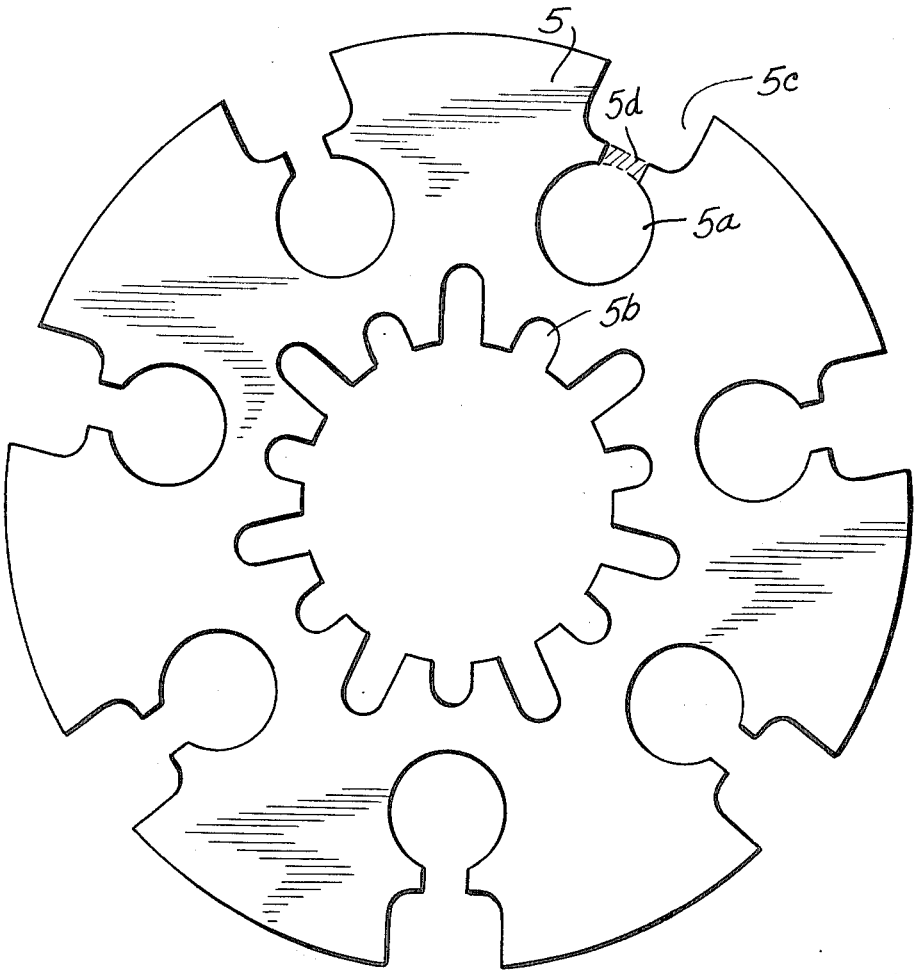
FIG. 9 is a detailed view of a second yoke.

Following is a most significant point relative to the explanation of the constructions which are disclosed herein. Since a plane relative position for the fulcrum 3*d* against which the moving element 16 is positioned and for the fixed iron core 1 must be determined, fulcrum member 3 is constructed so that it can be mated with the notched part of the second yoke 5, the notched part corresponding to the location of fixed iron core 1. As shown in FIG. 9, second yoke 5 has two notches 5*b* and 5*c* each corresponding to fixed iron core 1. Fulcrum member 3 including members 3*d*, 3*e*, 3*f* and 3*g* fits into notch 5*c* and projection 3*h* (FIGS. 3*a* and 3*b*) of fulcrum member 3 fits into notch 5*b*. The various fulcrum sections 3*d*, 3*e*, 3*f* and 3*g*, together, make up the projection 3*j* (FIG. 2) which is essentially hexagonal, and, the combination of the hexagonal projection 3*j* and projection 3*h* provides against rotation of the second yoke and fulcrum member 3 relative to each other. The fact that part 3*j* is a polygon having projecting angles also contributes to prevention of rotation.

By this construction, it becomes possible for moving iron core 6 to fit freely within fulcrum member 3 and through opening 5*a* of said second yoke. It should be noted, that it is not necessary that the openings into which the projections fit be either notches or completely enclosed openings. Preferably, opening 5*a* is made larger than opening 3*c* in order to prevent the side walls of moving iron core 6 from touching the interior walls of the openings or notches in second yoke 5. As aforenoted, openings 5*a* and 3*c* are not necessarily completely open, and for example as shown by the broken line of FIG. 9, relative to 5*a*, a portion of the opening (the shadowed part 5*d*) may be disconnected, forming part of a notch connected to the notched part 5*c*. Referring now to FIG. 4 in which the opening 7*d* in frame 7 is provided for engagement with projection 3*e* of fulcrum member 3, the fact that the opening is completely encircled shows that the fulcrum will maintain connection, that is, engagement with moving element 16.

Another embodiment of a moving element 16 is shown in FIG. 8 in which the frame 7 is bent in the portion thereof which engages fulcrum 3*d*, the bent-over portion lying within a groove portion 3*k*. Groove portion 3*k* can be formed completely within fulcrum member 3 or, alternatively, can be formed by the combination of fulcrum member 3 and a projection on holding member 8, said projection being shown as a shaded portion bounded by a dashed line. Finally, although not shown, groove 3*k* can be provided entirely within the holding member.

Although the embodiment of FIG. 8 is shown as providing for the holding member 8 pressing against moving element 16 so as to prevent it from separating from fulcrum 3*d*, there is inevitably some slight clearance between holding surface 8*a* and said moving element due to tolerance variations. As a result, when the moving element 16 is oscillated, the fulcrum 3*d* and surface 8*a* are subject to repeated impacts so that rapid abrasion may result. If an attempt is made to hold the moving element 16 forceably against fulcrum 3*d* by holding surface 8*a* despite tolerance requirements, the action and surface life of moving element 16 are adversely affected. Consequently, holding surface 8*a* should preferably press against moving element 16 through a spring member. In addition, the spring member should preferably be made integral with holding member 8. In the present case, a tongue-shaped spring member can actually be constructed by the technique of plastic molding so that it is integral with holding member 8. The principle of this invention may be extended to constructions other than the iron frame 7 and the moving iron piece 6 comprising an embodiment of the moving element 16.

As can therefore be seen, the construction according to the present invention can result in an inexpensive head for a dot printer which has much less variation in the gap between the fixed iron core and the moving member of an electromagnet. As a result, such a head for a dot printer can produce uniform printing quality with much less energy than is the case with conventional printers.

It will thus be seen that the objects set forth above, among those made apparent from the preceding description, are efficiently attained and, since certain changes may be made in carrying out the above process, in the described composition, and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A head portion of a dot printer of the type wherein activation of an electromagnet provides for thrust of a needle, comprising:

a first, cup-shaped yoke;

an electromagnet including a fixed iron core securely attached to said yoke, said iron core having an end portion;

a movable element disposed for movement by activation of said electromagnet from a rest position to a thrust position;

biasing means for returning said movable element from said thrust position to said rest position;

a second yoke shaped for fitting within said first yoke and for permitting movement of said element therethrough relative to said iron core;

a fulcrum member abutting said fixed magnetic core, said fulcrum member including a coil frame and fulcrum portion integral with each other, said member having a stepped surface abutting said end portion for positioning same relative to said fulcrum member and said movable element, said needle having a butt end; and a holding member for holding said movable element against said fulcrum portion.

2. A head portion of a dot printer as defined in claim 1, wherein one of said fulcrum member and said movable element includes a projection and the other includes an aperture for receiving said projection and for holding said movable element and said fulcrum portion in engagement.

3. A head portion of a dot printer as defined in claim 1, wherein said movable element is bent at the region thereof in contact with said fulcrum portion.

4. A head portion of a dot printer as defined in claim 1, wherein said movable element comprises a frame portion and an iron core portion securely attached thereto, said iron core portion being disposed for attraction by said electromagnet.

5. A head portion of a dot printer as defined in claim 1, further comprising a needle for forming dots, said movable element being disposed for activating said needle when brought into said thrust position against said butt end.

6. A head portion of a dot printer as defined in claim 5, wherein said movable element has two ends, one end thereof being disposed against said fulcrum portion, the other end thereof engaging said needle, and said iron core portion being intermediate said ends.

7. A head portion of a dot printer as defined in claim 5, wherein said coil frame is disposed between said fixed iron core and said second yoke.

8. A head portion of a dot printer as defined in claim 1, wherein said fulcrum member is engaged with said second yoke for establishing the relative positions thereof.

9. A head portion of a dot printer as defined in claim 1, wherein said movable element has an iron core portion and said fulcrum member and said second yoke each have an aperture for receiving said iron core portion.

10. A head portion of a dot printer as defined in claim 9, wherein said aperture in said fulcrum member is smaller than the corresponding aperture in said second yoke.

11. A head portion of a dot printer as defined in claim 1, wherein said fulcrum member includes positioning means for locating said holding member with respect to said fulcrum member.

12. A head portion of a dot printer as defined in claim 1, wherein said holding member includes guide means for locating said movable element during transit between said rest and thrust positions and stopper means for establishing said rest position.

13. A head portion of a dot printer as defined in claim 1, wherein said biasing means is a coil spring for urging said movable element against said fulcrum portion.

14. A head portion of a dot printer as defined in claim 1, wherein said holding member includes printed circuitry and is apertured for transit therethrough of a lead to said electromagnet.

15. A head portion of a dot printer as defined in claim 6, wherein said movable element has two ends, one end thereof being disposed for engaging said butt end of said needle, and the other end having securely attached thereto an iron core portion disposed for attraction to said electromagnet on activation thereof, a portion of said movable element intermediate said two ends engaging said fulcrum portion for rotation therearound.

16. A head portion of a dot printer as defined in claim 1, wherein said fulcrum member includes a projection thereon, and said second yoke has an aperture for receiving said projection, said projection and said aperture being shaped for preventing rotation of said fulcrum member relative to said second yoke.

17. A head portion of a dot printer as defined in claim 6, wherein the ratio of distance between said two ends to the distance from said iron core portion to said fulcrum portion is about 3:1.

18. A head portion of a dot printer as defined in claim 15, wherein the ratio of distance between said two ends to the distance from said iron core portion to said fulcrum portion is about 3:1.

19. A head portion of a dot printer as defined in claim 1, wherein said fulcrum member is of a molded component of synthetic resin.

20. A head portion of a dot printer as defined in claim 1, wherein said fulcrum member is of a sintered nonmagnetic material.

* * * * *